US006719416B2

(12) United States Patent
Anma et al.

(10) Patent No.: US 6,719,416 B2
(45) Date of Patent: Apr. 13, 2004

(54) INK CONTAINER PACKAGE

(75) Inventors: Hiromasa Anma, Kanagawa-Ken (JP); Masanori Takenouchi, Kanagawa-Ken (JP); Yoshihisa Takizawa, Tokyo (JP); Yasuo Kotaki, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 10/139,340

(22) Filed: May 7, 2002

(65) Prior Publication Data

US 2002/0186284 A1 Dec. 12, 2002

(30) Foreign Application Priority Data

May 10, 2001 (JP) ..... 2001-140104
Apr. 24, 2002 (JP) ..... 2002-122442

(51) Int. Cl.[7] ..... B41J 2/175
(52) U.S. Cl. ..... 347/86
(58) Field of Search ..... 347/86, 87; 206/205, 206/550

(56) References Cited

U.S. PATENT DOCUMENTS

| | | | | |
|---|---|---|---|---|
| 5,359,357 A | | 10/1994 | Takagi et al. | 347/49 |
| 5,448,274 A | | 9/1995 | Hirabayashi et al. | 347/86 |
| 5,619,237 A | | 4/1997 | Inoue et al. | 347/86 |
| 5,701,995 A | * | 12/1997 | Higuma et al. | 206/205 |
| 5,742,311 A | | 4/1998 | Koitabashi et al. | 347/86 |
| 5,784,088 A | | 7/1998 | Ujita et al. | 347/86 |
| 5,850,238 A | | 12/1998 | Karita et al. | 347/29 |
| 5,934,475 A | | 8/1999 | Hikake et al. | 206/722 |
| 6,113,230 A | | 9/2000 | Ishinaga et al. | 347/86 |
| 6,164,769 A | * | 12/2000 | Inada et al. | 347/86 |
| 6,168,266 B1 | * | 1/2001 | Ishinaga et al. | 347/86 |
| 6,270,207 B1 | * | 8/2001 | Sasaki | 347/86 |

FOREIGN PATENT DOCUMENTS

| | | |
|---|---|---|
| EP | 514632 | 11/1992 |
| EP | 627317 | 12/1994 |
| EP | 765756 | 4/1997 |
| EP | 792749 | 9/1997 |
| EP | 922653 | 6/1999 |
| JP | 6-293854 | 10/1994 |
| JP | 11-170554 | 6/1999 |
| JP | 11-310266 | 11/1999 |

* cited by examiner

*Primary Examiner*—Anh T. N. Vo
(74) *Attorney, Agent, or Firm*—Fitzpatrick, Cella, Harper & Scinto

(57) ABSTRACT

A package includes a packaging member; and an ink container which contains ink comprising pigment coloring material and solvent dispersing the coloring material and which has an ink supply port for permitting supply of the ink to an outside, wherein the ink container is mountable to an ink jet recording apparatus with the ink supply port at a lower position, the ink container accommodating an ink absorbing material for absorbing the ink and being provided with an air vent which is open for fluid communication between a space inside the ink container and ambience, and wherein a region tending to have a high coloring material density in the ink container is at a position generally diagonally opposite the ink supply port, wherein the ink container is in a first orientation which is different from a second orientation taken in use in the ink jet recording apparatus.

5 Claims, 8 Drawing Sheets

INK CONTAINER PACKAGE

FIELD OF THE INVENTION AND RELATED ART

The present invention relates to a package for an ink container accommodating ink to be supplied to an ink jet recording apparatus for effecting effect by ejecting liquid such as ink or the like to a recording material.

Conventionally, an ink container for supplying the ink to the ink jet recording apparatus is detachably mountable to the ink jet recording apparatus, and after the ink accommodated therein is used up, it is replaced with a new one.

Japanese Laid-open Patent Application Hei 6-293854, Japanese Laid-open Patent Application Hei 11-170554, Japanese Laid-open Patent Application Hei 11-310266 and so on disclose packages for such ink containers, for use during transportation or when they are stored. The package disclosed in them are intended to prevent evaporation of the volatile matter in the ink accommodated in the ink container or to protect the ink container from shock by vibration or falling during transportation or the like.

In the case that ink accommodated in the ink container comprises coloring material which is a pigment and liquid medium for dispersing the pigment, the coloring material settles due to the gravity when the ink container is placed with the same position or orientation for a long term during transportation or the like, with the result of non-uniform coloring material density distribution in the ink container.

Here, the settling is a phenomenon in which fine particles settles due to the gravity, and the degree of settling is determined by the settling velocity in the direction of the gravity defined by the Stokes equation and the Brownian movement when the coagulation of the particles does not occur.

Stokes equation:

$$Vs=2a(\rho-\rho_o)g/9\eta \quad (1)$$

Where Vs is a settling velocity, "a" is a radius of the particle, $\rho$ is a density of the particles, $\rho_o$ is a density of the solvent, g is the gravitational acceleration, $\eta$ is a viscosity of the solvent.

Brownian movement:

$$X=(RTt/3\pi NA\eta a)$$

where X is an average movement distance of the particles per time t, R is a gas constant, T is an absolute temperature, NA is an Avogadro number, $\eta$ is a viscosity of the medium, an is a radius of the particle.

When the settling velocity of the particles are ruling over the scattering by the Brownian movement, the particles settle.

When an air vent is provided in the ink container for the purpose of fluid communication between the inner space in the ink container and the ambience, the volatile matter in the ink evaporates through the air vent, by which the coloring material density of the ink in the ink container becomes non-uniform, too. Particularly when the air vent is disposed in a side other than a side opposed to the side having the ink supply port, the increase of the coloring material density adjacent the ink supply port is remarkable due to the settling of the coloring material and the evaporation of the ink component.

In addition, when an ink absorbing material for absorbing and retaining the ink is provided in the ink container, the coloring material does not easily move in the ink absorbing material since the fibers are interraced in a complicated manner. Therefore, it will not work to shake the ink container immediately before the start of use, because the coloring material is not dispersed. Once the density gradient is produced in the ink absorbing material, quick redispersion or rediffusion is not easy. FIG. 9 is a perspective view of a conventional package containing an ink container. The ink container 1101 contained in the package 1106 has an ink absorbing material 1104 therein to retain the ink comprising as a coloring material self-dispersion type carbon black. An air vent 1103 is provided in the upper or top surface (as seen on the Figure) of the ink container 1101 at a position away from the inside ink absorbing material 1104 by a rib (unshown), and an ink supply port 1102 is provided in a lower or bottom surface (opposite the upper surface) at a position substantially diagonal relative to the air vent 1103. The ink container 1101 is contained in the package 1106 with the air vent 1103 open with such an orientation that ink supply port 1102 takes a bottom position, and the air vent 1103 takes a top position.

When the package 1106 is placed under the state for a long term, the coloring material in the ink in the ink container 1101 settles, and the volatile component in the ink evaporates through the air vent 1103 with the result of the state in which the coloring material density (content) in the ink is high adjacent the ink supply port 1102 at the bottom of the ink container 1101 and below the air vent 1103, as indicated by region 1105.

When the ink container 1101 is set in the ink jet recording apparatus, the ink supply port 1102 takes the bottom position. In other words, the ink container 1101 is set in the ink jet recording apparatus with the same orientation as that during the transportation. However, if the ink container 1101 is placed under the same orientation for a long term, the coloring material density is high in the adjacent region to the ink supply port 1102. The ink having the high coloring material density exhibits a low flowability, and therefore, when such ink is supplied to the ink jet recording head, it may clog the nozzles of the recording head, or may be deposited and solidified on the ink ejection outlet side surface of the recording head with the possible result of proper image recording operations. In addition, the ejection particularly property of the recording head is deteriorated to prevent the proper image recording.

Moreover, with the consumption of the ink from the beginning of the use of the ink container 1101, the coloring material density of the ink decreases, and therefore, the quality of the recorded image changes with use, and the quality in the beginning and that immediately before the ink is used up are different from each other. Since the ink is retained in the ink absorbing material 1104 wherein the fibers are interraced in a complicated manner. Therefore, even if the ink container 1101 is shook before the start of use, and the coloring material in the high density region 1105 is not quickly dispersed, and therefore, the high coloring material density ink is supplied to the recording head.

SUMMARY OF THE INVENTION

Accordingly, it is a principal object of the present invention to provide a package wherein even if a coloring material density or distribution in the ink in the ink container becomes non-uniform during transportation, supply of the high coloring material density ink from the ink container is effectively prevented.

According to an aspect of the present invention, there is provided a package for containing an ink container which contains ink comprising pigment coloring material and solvent dispersing the coloring material and which has an ink supply port for permitting supply of the ink to an outside, said package, wherein said ink container is in a first orientation which is different from a second orientation taken in use in said ink jet recording apparatus.

According to the present invention, even if the coloring material density distribution of the ink in the ink container becomes non-uniform due to settling of the coloring material in the ink, during the transportation, the coloring material can be distributed to make the coloring material density distribution more uniform. Even if the high coloring material density region is produced neighborhood the ink supply port, supply of the high coloring material density can be effectively prevented.

In said first orientation, it is preferable that said ink supply port is at a level higher than a region in which the coloring material density in the ink is relatively high due to settling of the coloring material. Because of this, production of high coloring material density region is prevented in the neighborhood of the ink supply port. When the ink supply port takes the bottom position upon use of the ink container in the recording apparatus, the region where the coloring material density is relatively high is present above the ink supply port, the coloring material in the region is dispersed toward the ink supply port. As a result, the coloring material is further dispersed in the ink, so that more uniform ink is supply to the outside.

It may be that in said first orientation said ink supply port and an air vent for fluid communication between an inside of said container and the ambience are disposed substantially opposed to each other, and in the first orientation, the ink supply port is at a position higher than the air vent. Through the air vent, the volatile component in the solvent evaporates, and therefore, the coloring material density in the ink becomes higher with time adjacent the air vent, but the adverse influence thereof can be minimized by the disposition of the air vent.

According to a further aspect of the present invention, there is provided a package containing comprising: a packaging member; and An ink container which contains ink comprising pigment coloring material and solvent dispersing the coloring material and which has an ink supply port for permitting supply of the ink to an outside, wherein the ink container is mountable to an ink jet recording apparatus with the ink supply port at a lower position, said ink container accommodating an ink absorbing material for absorbing the ink and being provided with an air vent which is open for fluid communication between a space inside said ink container and ambience, wherein said ink container has, at a side adjacent a side having said ink supply port, a first portion and a second portion which is projected outwardly of the ink container beyond the first portion, said first portion continuing with the side having the ink supply port, wherein said adjacent side takes a lower position.

According to this aspect of the present invention, if the coloring material settles during transportation, a relatively high coloring material density region is produced adjacent a side close to the side having the ink supply port in the ink container. If the ink supply port takes a bottom position when the ink container is in use, the region having the relatively high coloring material density is positioned above the ink supply port, and the coloring material in such a region is dispersed toward the ink supply port. At this time, the moving coloring material abuts the step between the first portion and the second portion by which it is dispersed toward the central region in the ink container. By doing so, the coloring material is further effectively dispersed in the ink, and uniform ink can be supplied to the outside.

It may be that ink supply port takes in said package a position at a higher level than a relatively high coloring material density region in the ink resulting from settling of the coloring material in said package.

It may be that in said first orientation said ink supply port and said air vent are disposed substantially opposed to each other, and in the first orientation, the ink supply port is at a position higher than the air vent.

It may be that ink container has therein an ink absorbing material for absorbing the ink.

It may be that pigment is carbon black.

It may be that carbon black is self-dispersion type carbon black.

It may be that pigment is color pigment.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 6(*b*) is a perspective view of the ink container of FIG. 6(*a*) in use.

FIG. 6(*c*) is a perspective view of the ink container of FIG. 6(*a*) in use.

FIG. 6(*d*) is a perspective view of the ink container of FIG. 6(*a*) in use.

DESCRIPTION OF THE PREFERRED EMBODIMENTS

Referring to the accompanying drawings, the embodiments of the present invention will be described.

Figure 1:
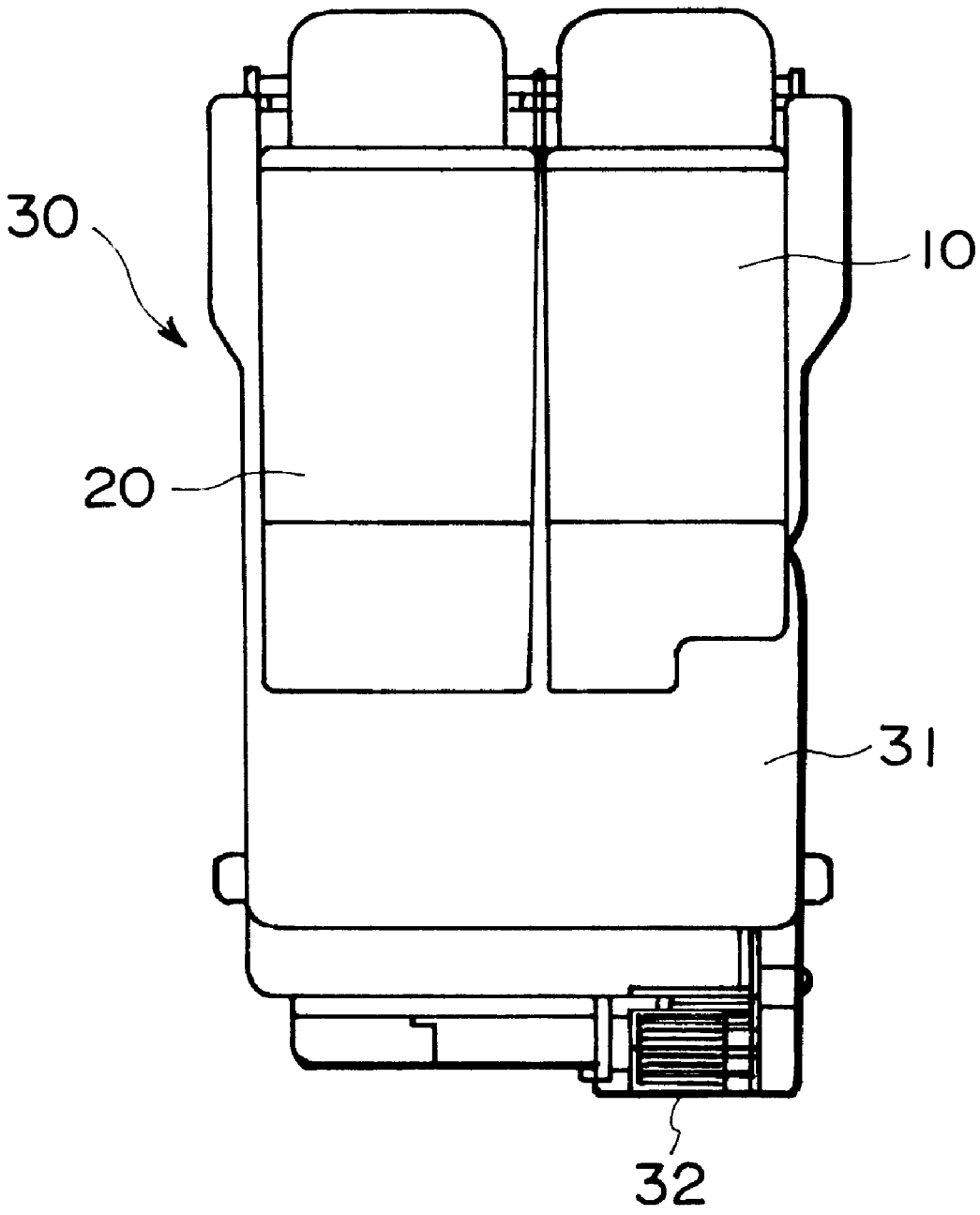
FIG. 1 is a front view of an ink jet cartridge usable with the present invention.
Figure 2:
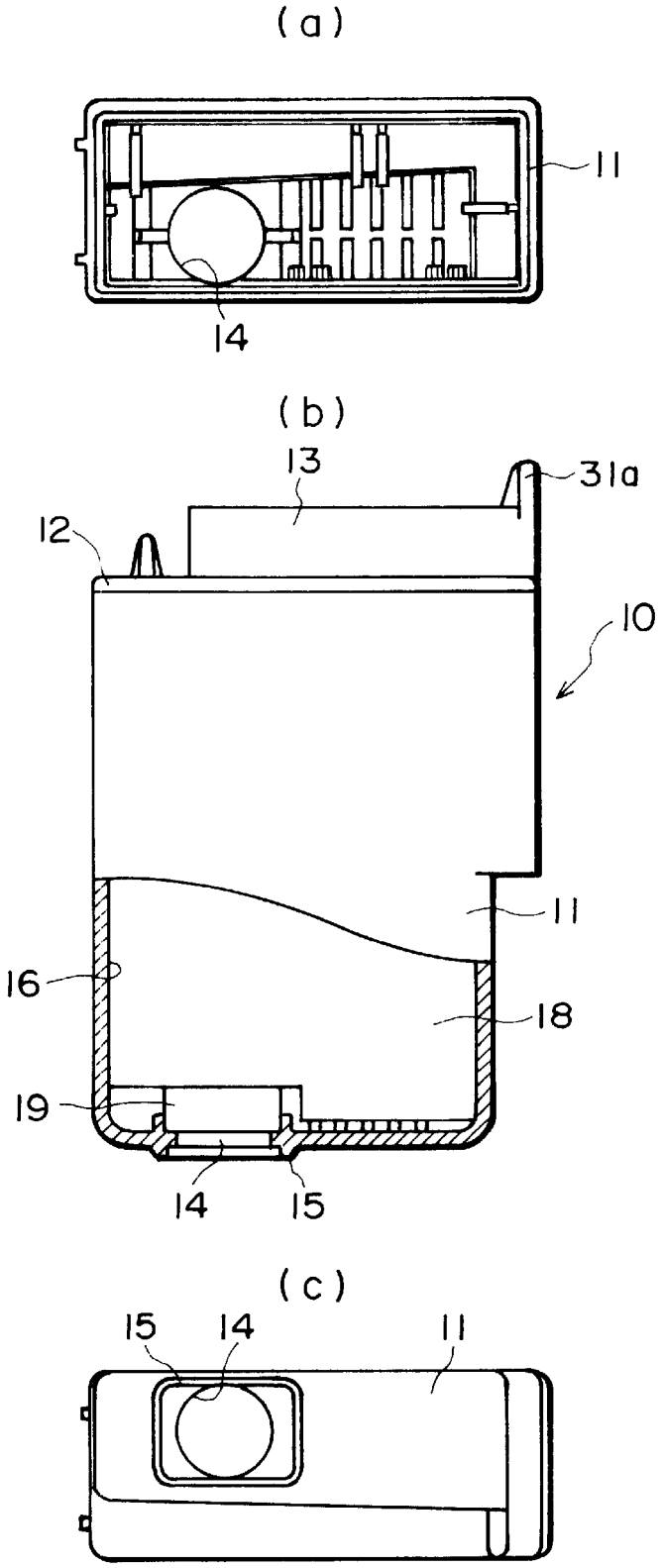
FIG. 2 is an illustration of a black ink container shown in FIG. 1.
Figure 3:
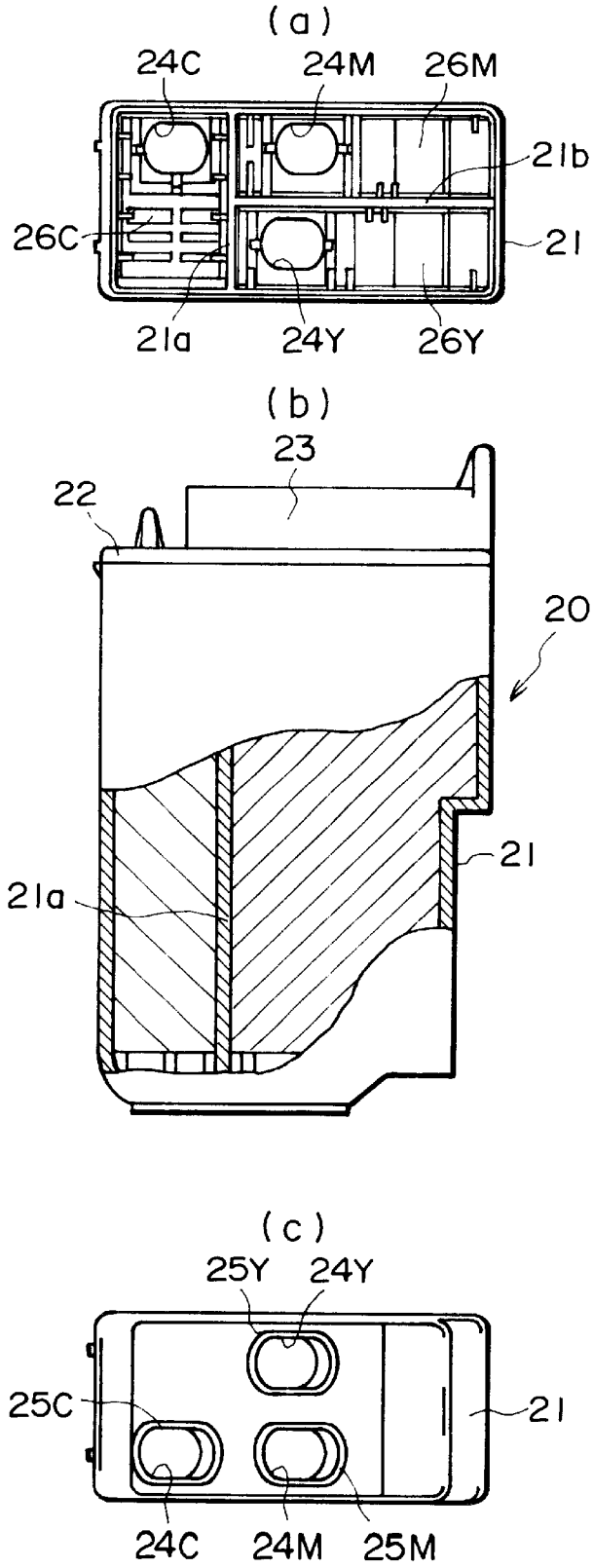
FIG. 3 is an illustration of a color ink container shown in FIG. 1.

Referring to FIGS. 1–3, the ink jet cartridge will be described.

FIG. 1 is a front view of an ink jet cartridge usable with the present invention. As shown in FIG. 1, the ink jet cartridge 30 comprises a holder 31 having an integral ink jet head 32 for ejecting the ink, a black ink container 10 and a color ink container 20 which are detachably mounted in the holder 31. The black ink container 10 and the color ink container 20 contain the ink to be supplied to the ink jet head 32, and the black ink container 10 contains black ink, and the color ink container 20 contains yellow ink, cyan ink and magenta ink (three color). The ink jet head 32 is placed at the bottom of the holder 31 in use, and has a plurality of groups of ejection outlets (unshown) corresponding to the respective color inks supplied from the black ink container 10 and the color ink container 20. In a connecting portion of the holder 31 relative to the black ink container 10 and a connecting portion relative to the color ink container 20, there are provided projected ink receiving tubes (unshown) corresponding into the respective color inks. The ink receiving tubes are connected with groups of corresponding injection outlets through respective ink supply passages (unshown).

When the black ink container 10 is mounted to the holder, the black ink in the black ink container 10 is supplied into the groups of the black ink ejection outlets through the black ink ink receiving tube and ink supply passage. Similarly, when the color ink container 20 is mounted to the holder, the color inks in the color ink container are supplied to the respective groups of color ejection outlets through respective ink receiving tubes and ink supply passages. Each of the free ends of the ink receiving tubes is provided with a filter (unshown) to prevent foreign matter from entering the ink receiving tube.

Referring to FIG. 2, the black ink container 10 will be described. FIG. 2 illustrated a black ink container shown in FIG. 1, and more particularly, a top plan view (a), a partly broken side view (b), and a bottom view (c). In (a) of FIG. 2, the cap member and the ink absorbing material are omitted for simplicity of exportation.

The black ink container 10 comprises a casing 11 which constitutes an ink accommodating portion 16 for the black ink and which is open at the upper end, a cap member 12 closing the opening of the casing 11 and having an air vent (unshown) formed therein, an upper member material 13 which covers the air vent of the cap member 12 and which has a buffer space for preventing the ink leaked through the air vent from flowing to the outside. The upper member 13 has an opening (unshown) open to the ambience at a position different from the air vent of the cap member 12 and has a picking portion 13*a* for facilitating mounting and demounting of the holder 31 (FIG. 1).

The casing 11 is provided in the bottom portion with an ink supply port 14 at a position opposing into the black ink ink receiving tube of the holder when the black ink container 10 is mounted to the holder 31. Around the ink supply port 14, there is formed a rib 15 for preventing the ink supplied from the black ink container 10 through the ink receiving tube from leaking into the holder 31. The ink accommodating portion 16 contains therein an ink retaining member 18 for absorbing and retaining the black ink. Between the ink retaining member 18 and the bottom wall of the black ink container 10, there is provided an ink leading member 19 which closes the ink supply port 14 from the inside. The ink leading member 19 absorbs and retains the ink similarly to the ink retaining member 18. The ink retaining force of the ink leading member 19 is higher than the ink retaining force of the ink holding member 18. Therefore, the ink retained in the ink holding member 18 is effectively led to the ink leading member 19, and the usability of the ink retained in the ink holding member 18 is improved.

When the black ink container 10 is mounted to the holder 31, the ink receiving tube is contacted to the ink leading member 19 in the ink supply port 14, and the ink retained in the ink leading member 19 is supplied into the groups of the ejection outlets of the ink jet head 32 through the black ink ink receiving tube and the ink supply passage.

Referring to FIG. 3, the color ink container 20 will be described. FIG. 3 shows a color ink container shown in FIG. 1, more particularly, a top plan view (a), a partly broken side view (b), and a bottom view (c). In (a) of FIG. 3, the cap member and the ink absorbing material are omitted for simplicity of exportation.

The color ink container 20 has a structure which is fundamentally the same as the black ink container 10 and comprises a casing 21 for accommodating the inks, a cap member 22 having an air vent (unshown), and an upper member 23.

The inside of the casing 21 is partitioned by partition walls 21*a*, 21*b* which constitute a T-shape in a cross-section along a horizontal plane (in the state of use) to divide the inside space into three chambers which corresponds the ink receiving tubes of the holder 31, respectively. The three chambers constitutes an ink accommodating portion 26Y for the yellow ink, an ink accommodating portion 26C for the cyan ink, and an ink accommodating portion 26M for the magenta ink. The air vent of the cap member 22 is provided for each of the ink accommodating portions 26Y, 26C, 26M.

The casing 21 is provided in the bottom portion with ink supply ports 24Y, 24C, 24M at the positions opposed to the respective ink receiving tubes for the color inks when the color ink container is mounted to the holder 31, and around the ink supply ports 24Y, 24C, 24M, ribs 25Y, 25C, 25M for preventing the ink leakage is formed.

In each of the ink accommodating portion 26Y, 26C, 26M, there are provided an ink retaining member for absorbing and retaining the ink and an ink leading member, similarly to the black ink container 10 shown in FIG. 2.

The embodiments of the packages will be described. In the following description, the above-described ink containers are shown as simplified manner.

(First Embodiment)

Figure 4:
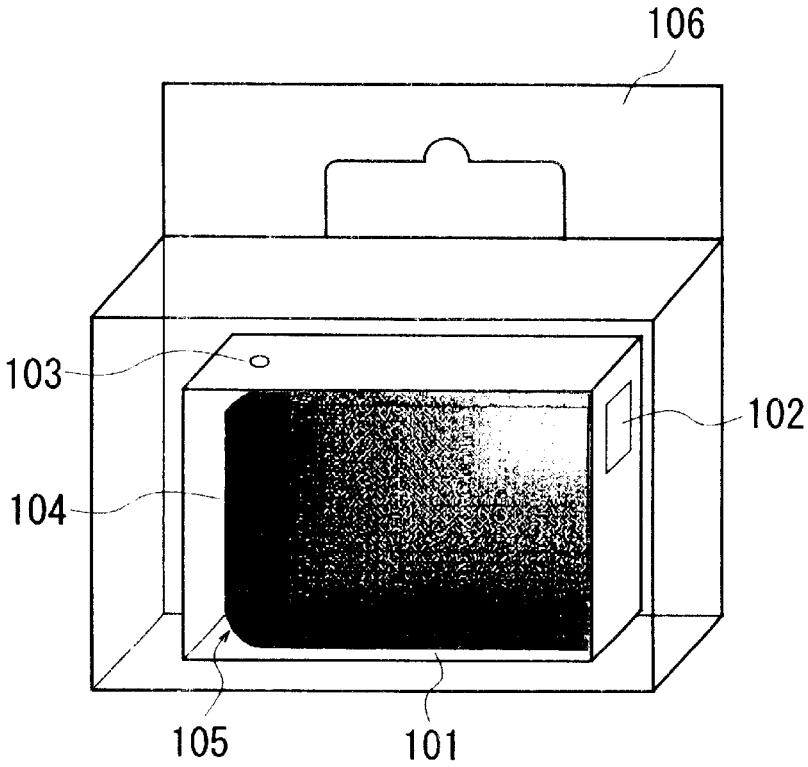
FIG. 4 is a perspective view of a package according to a first embodiment of the present invention, which package contains an ink container.

FIG. 4 is a perspective view of a package according to a first embodiment of the present invention, which package contains an ink container.

In the ink container 101 contained in the package 106 of this embodiment, an ink absorbing material 104 retaining the ink comprising self-dispersion type carbon black as a coloring material is packed. An air vent 103 is provided in the upper or top side (as seen on the Figure) of the ink container 101 at a position away from the inside ink absorbing material 104 by a rib (unshown), and an ink supply port 102 is provided in a top right side (opposite the upper side). The ink container 101 is contained in the package 106 with the air vent 103 open with such an orientation that ink supply port 102 is direct horizontally, and the air vent 103 is directed to top.

When the package 106 is placed under the state for a long term, the coloring material in the ink in the ink container 101 settles, and the volatile component in the ink evaporates through the air vent 103 with the result of the state in which the coloring material density (content) in the ink is high at the bottom of the ink container 101 and below the air vent 103, as indicated by region 105. According to this embodiment, the ink container 101 is contained in the package 106 with such an orientation that ink supply port 102 takes a position at a level higher than the high density region 105 (with respect to the direction of the gravity). Therefore, in this embodiment, the coloring material density in the adjacent region to the ink supply port 102 is not high. The ink container 101 is mounted to the ink jet recording apparatus with the ink supply port 102 side at directed downward with respect to the direction of the gravity. In this state, the high density region 105 is adjacent the side surface of the ink container and the and the top side. The coloring material in the high density region 105 begins settling downward, that is, toward the ink supply port 102. By this, the coloring material in the high density region 105 is dispersed in the entirety of the ink container 101 so that coloring material density distribution in the ink in the ink container 101 is made more uniform.

Since the ink in which the coloring material density is made more uniform is supplied from the ink container 101 to the recording head, the recording head is protected from nozzle clogging or solidification of the ink on the ink ejection outlet surface, thus assuring the proper image recording. In addition, the coloring material density of the ink supplied to the recording head is substantially constant from the beginning of the use of the ink container 101 until the ink is used up. The qualities of the recorded images at the beginning of the use of the ink container 101 and that immediately before the ink is used up are not significantly different.

(Second Embodiment)

Figure 5:
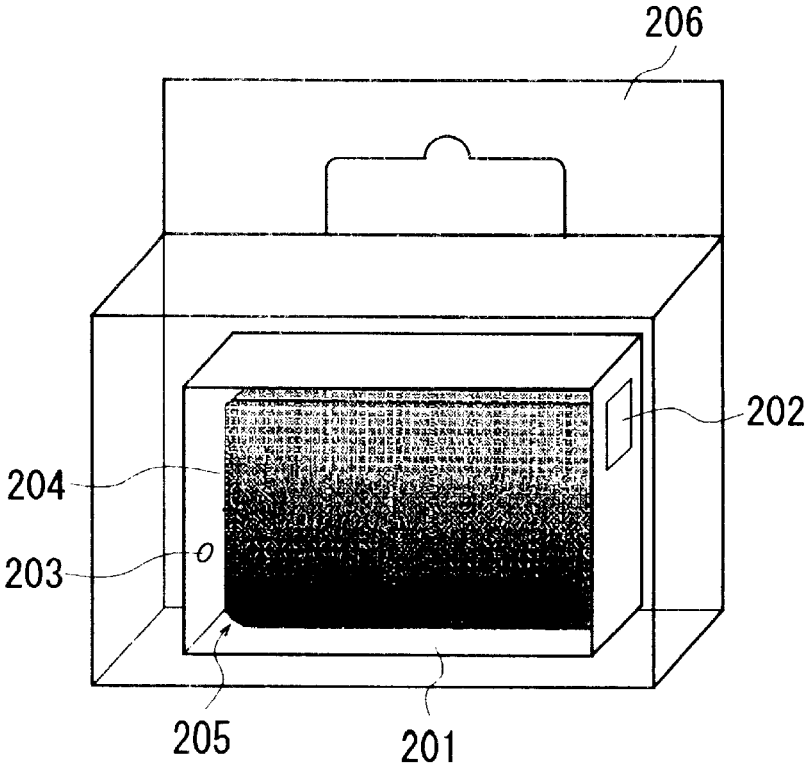
FIG. 5 is a perspective view of a package according to a second embodiment of the present invention, which package contains an ink container.

FIG. 5 is a perspective view of a package according to a second embodiment of the present invention, which package contains an ink container.

In the ink container 201 contained in the package 206 of this embodiment, an ink absorbing material 204 retaining the ink comprising self-dispersion type carbon black as a coloring material is packed. An air vent 203 is provided in the bottom left side (as seen on the Figure) of the ink container 201 at a position away from the inside ink absorbing material 204 by a rib (unshown), and an ink supply port 202 is provided in a top right side (opposite the bottom left side). The ink container 201 is contained in the package 206 with the air vent 203 open with such an orientation that ink supply port 202 and the air vent 203 are horizontally directed. When the package 206 is placed under the state for a long term, the coloring material in the ink in the ink container 201 settles, and the volatile component in the ink evaporates through the air vent 203 with the result of the state in which the coloring material density (content) in the ink is high at the bottom of the ink container 201 and adjacent the air vent 203, as indicated by region 205. According to this embodiment, the ink container 201 is contained in the package 206 with such an orientation that ink supply port 202 takes a position at a level higher than the high density region 205 (with respect to the direction of the gravity) and that air vent 203 takes the position substantially at the same level as the high density region 205. Therefore, in this embodiment, th coloring material density adjacent the ink supply port 202 is not high, and the coloring material density adjacent the air vent 203 is high.

When the ink container 201 is set in the ink jet recording apparatus, the ink supply port 202 takes the bottom position. In this state, the high density region 205 is adjacent the side surface of the ink container and the and the top side. The coloring material in the high density region 205 begins settling downward, that is, toward the ink supply port 202. By this, the coloring material in the high density region 205 is dispersed in the entirety of the ink container 201 so that coloring material density distribution in the ink in the ink container 201 is made more uniform.

Since the ink in which the coloring material density is made more uniform is supplied from the ink container 101 to the recording head, the recording head is protected from nozzle clogging or solidification of the ink on the ink ejection outlet surface, thus assuring the proper image recording. In addition, the coloring material density of the ink supplied to the recording head is substantially constant from the beginning of the use of the ink container 201 until the ink is used up. The qualities of the recorded images at the beginning of the use of the ink container 201 and that immediately before the ink is used up are not significantly different.

(Third Embodiment)

Figure 6:
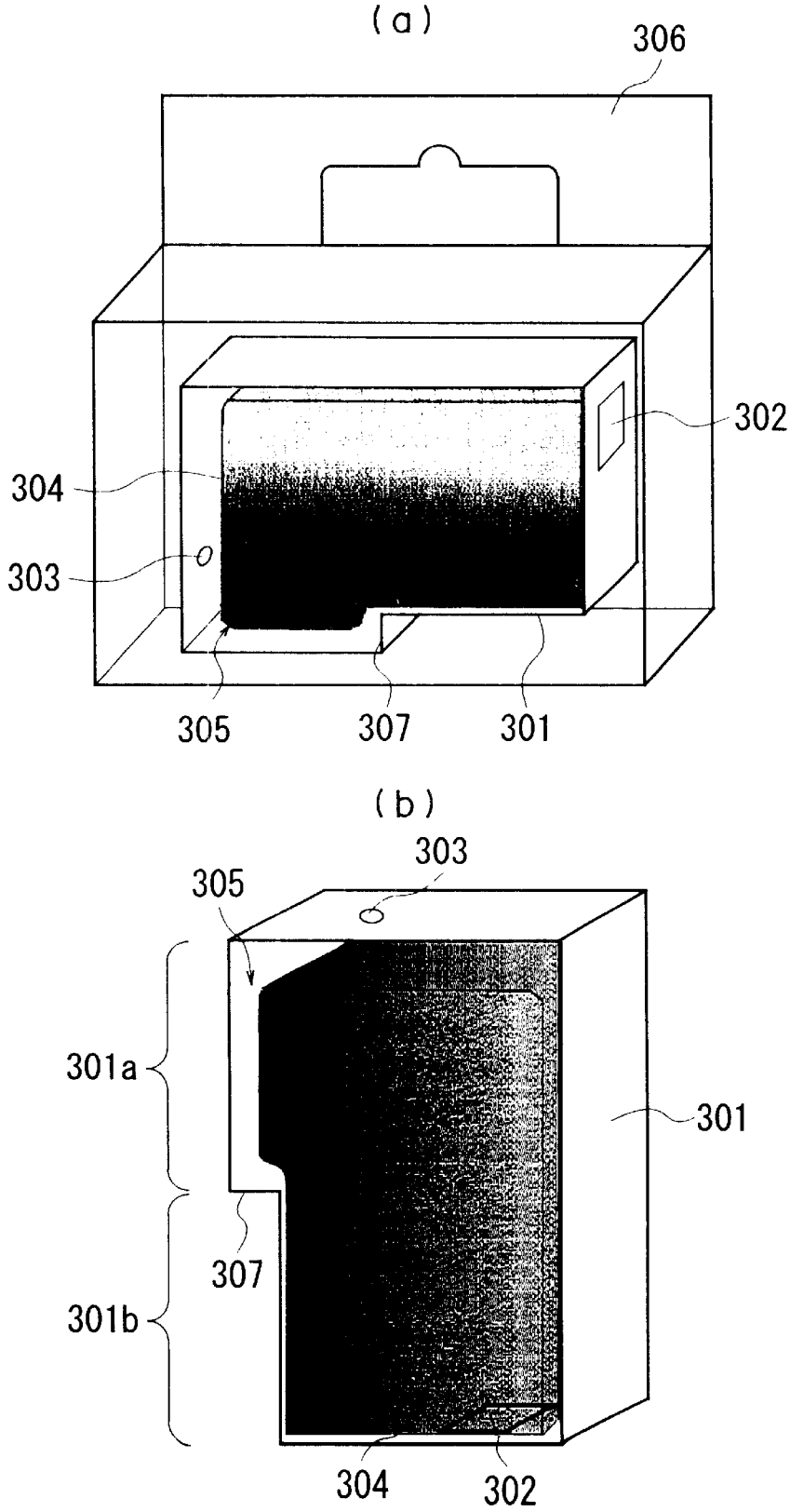
FIG. 6(*a*) is a perspective view of a package according to a third embodiment of the present invention, which package contains an ink container.
Figure 6:
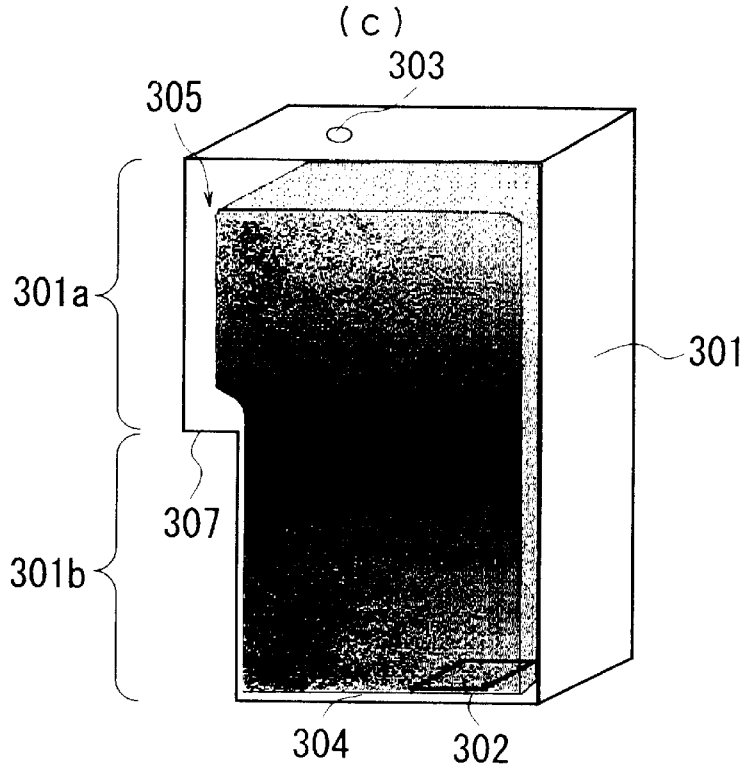
Figure 6:
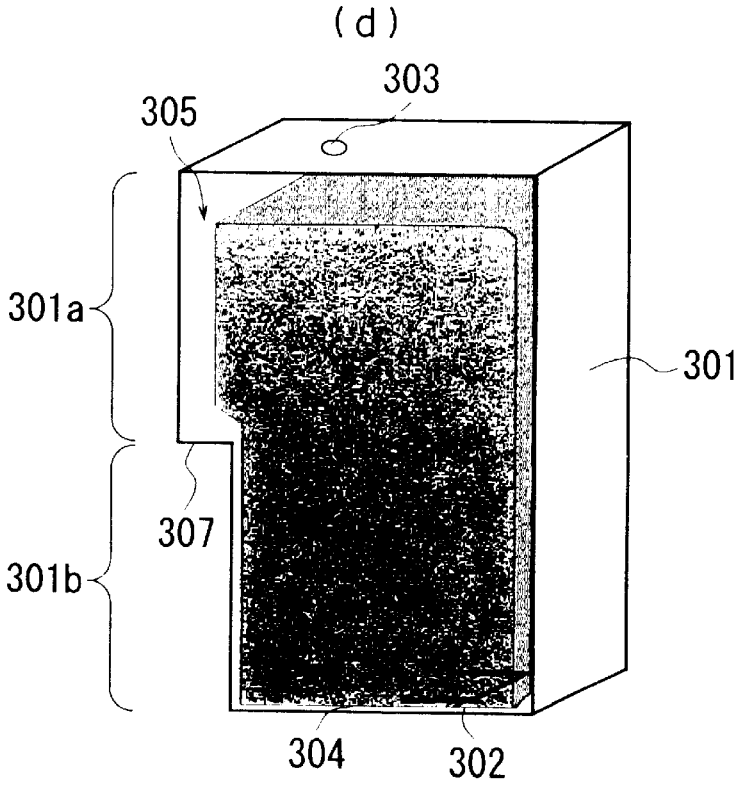

FIG. 6(*a*) is a perspective view of a package according to a third embodiment of the present invention, which package contains an ink container.

In the ink container 301 contained in the package 306 of this embodiment, an ink absorbing material 304 retaining the ink comprising self-dispersion type carbon black as a coloring material is packed. An air vent 303 is provided in the bottom left side (as seen on the Figure) of the ink container 301 at a position away from the inside ink absorbing material 304 by a rib (unshown), and an ink supply port 302 is provided in a top right side (opposite the bottom left side).

Figure 7:
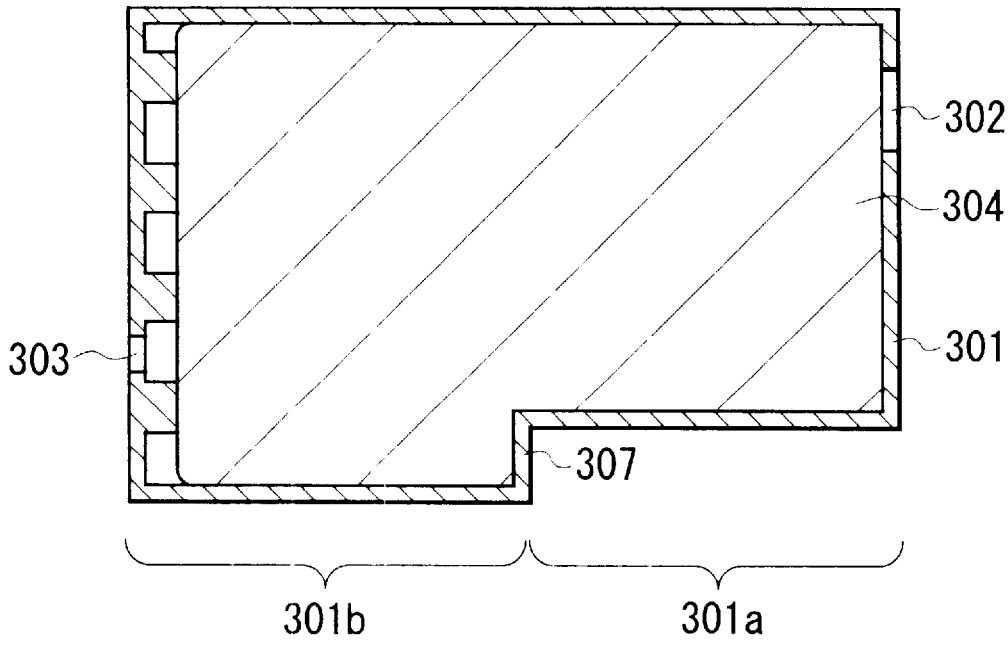
FIG. 7 is a longitudinal sectional view of an ink container shown in FIG. 6(*a*).

FIG. 7 is a longitudinal sectional view of an ink container shown in FIG. 6(*a*).

The ink container 801 has a first portion 301*a* and a second portion 301*b* on a side (bottom in the Figure) adjacent to the side having the ink supply port 302 (right side), the first portion 301*a* continuing with the side having the ink supply port 302. The second portion 301*b* is projected beyond the first portion 301*a*. Between the first portion 301*a* and the second portion 301*b*, a step 307 is formed. The ink absorbing material 304 exists inside the second portion 301*b*.

Referring back to FIG. 6(*a*), the ink container 301 is contained in the package 206 with the air vent 303 open and with the ink supply port 302 and the air vent 303 at the vertical sides, and with the surface which continues with the side having the ink supply port 302 and which has the first and second portions 301*a*, 301*b* facing down.

When the package 306 is placed under the state for a long term, the coloring material in the ink in the ink container 301 settles, and the volatile component in the ink evaporates through the air vent 303 with the result of the state in which the coloring material density (content) in the ink is high at the first and second portions 301*a*, 301*b* of the bottom of the ink container 301 and adjacent the air vent 303, as indicated by region 305. However, the ink container 301 of this embodiment is contained in the package 306 with such an orientation that ink supply port 302 is positioned at a level higher than the high density region 305 (higher with respect to the direction of gravity) and that air vent 303 is substantially at the same level as the high density region 305. Therefore, the coloring material density becomes high adjacent to the air vent 303, but the coloring material density does not become high adjacent the ink supply port 302.

FIGS. 6(*b*), 6(*c*) and 6(*d*) are perspective views of the ink container of FIG. 6(*a*) in use.

As shown in FIG. 6(*b*), the ink container 301 is mounted to the ink jet recording apparatus with the ink supply port 302 at the bottom side. In this orientation, the high density region 805 is positioned adjacent the lateral (vertical) side and top side and starts to settle downward, that is, toward the ink supply port 302 in the ink container 301. Then, the coloring material settled in the second portion 301*b* of the ink container 301 impinges the step 307 upon the start of the settling movement. By the impingement, the direction of the movement changes toward the central portion of the ink container 201, thus disperses widely. As shown in FIG. 6(*c*), the coloring material density distribution in the ink container 201 becomes further uniform. Since the ink in which the coloring material density is made more uniform is supplied from the ink container 301 to the recording head, the recording head is protected from nozzle clogging or solidification of the ink on the ink ejection outlet surface, thus assuring the proper image recording. In addition, the coloring material density of the ink supplied to the recording head is substantially constant from the beginning of the use of the ink container 301 until the ink is used up. The qualities of the recorded images at the beginning of the use of the ink container 301 and that immediately before the ink is used up are not significantly different.

(Fourth Embodiment)

Figure 8:
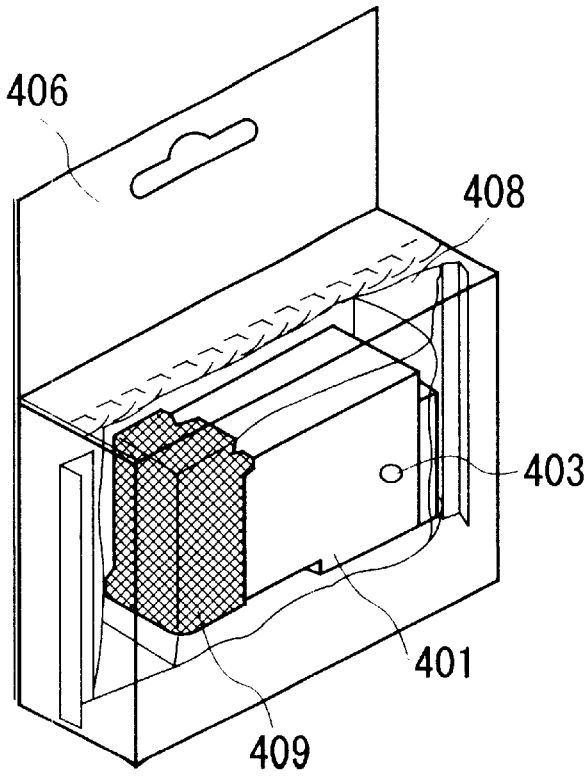
FIG. 8 is a perspective view of a package according to a fourth embodiment of the present invention, which package contains an ink container.
Figure 9:
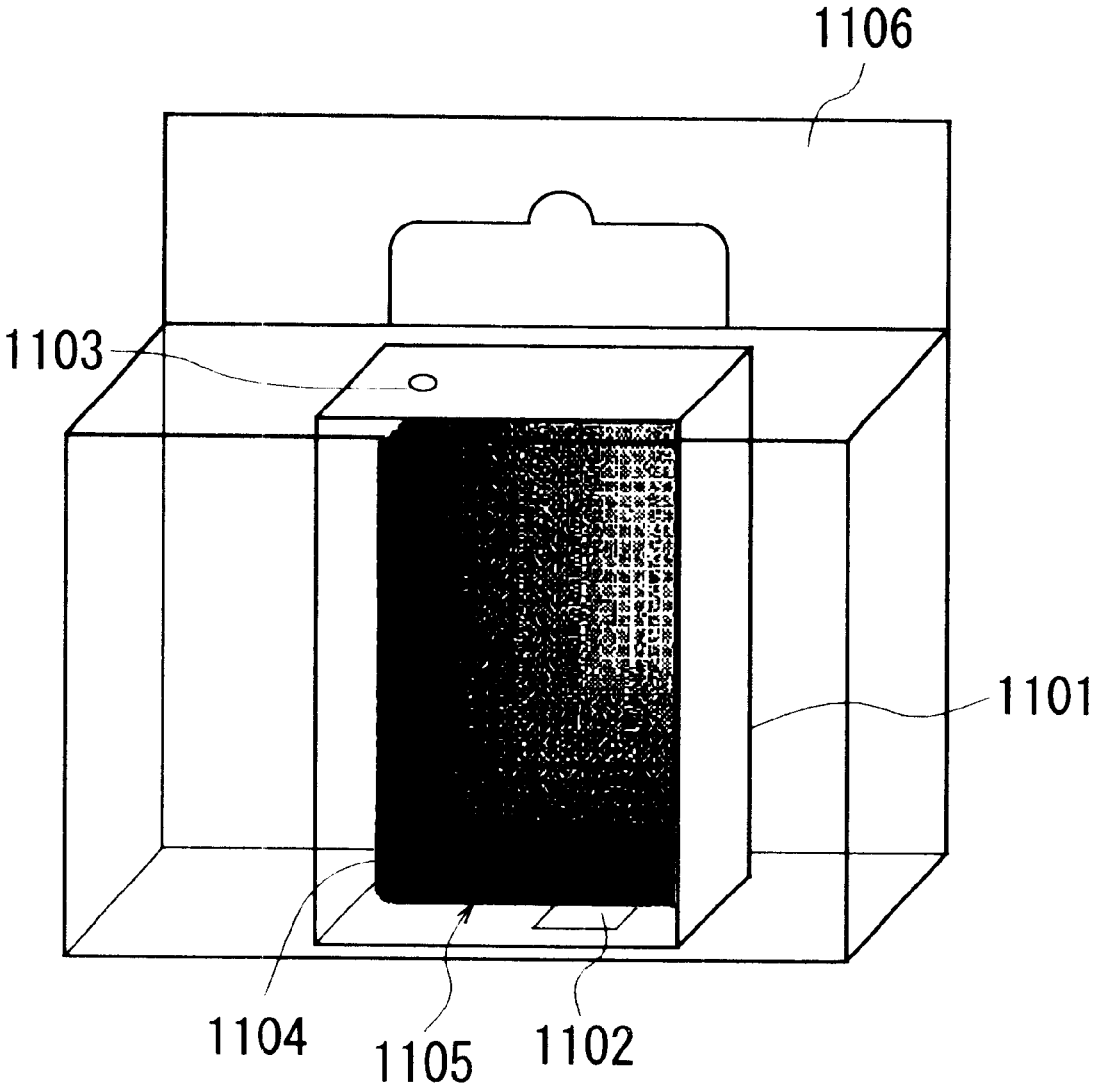
FIG. 9 is a perspective view of a conventional package containing an ink container.

FIG. 8 is a perspective view of a package according to a fourth embodiment of the present invention, which package contains an ink container.

The ink container 401 contained in the package 406 has an ink absorbing material (unshown) therein to retain the ink comprising as a coloring material self-dispersion type carbon black. An air vent 403 is provided in the lower right side (as seen on the Figure) of the ink container 401 at a position away from the inside ink absorbing material 404 by a rib (unshown), and an ink supply port (unshown) is provided in an upper left side (opposite the bottom right side) at a position substantially diagonal relative to the air vent 403.

A cap 409 is mounted to seal and protect the ink supply port (unshown) to suppress evaporation of the ink. The material of the sealing member constituting the cap 409 may be thermoplastic elastomer, the protecting member thereof may be polypropylene or the like, and other materials are usable for them, if the materials have the evaporation suppression effect. The number of the constituent parts may be single or plural. The ink container 401 is protected by a packaging material 408 and the package 406 (double packaging), and the packaging material 408 is effective to provide an evaporation suppression functions. The material of the packaging material 408, for example, is aluminum lamination, aluminum evaporated film, alumina evaporated film, SiOx evaporated film or the like which have ink evaporation suppression, or other materials are usable if the evaporation suppression effect is provided. As shown in FIG. 8, the ink container 401 is contained in the package 406 such that inner surface of the package 406 receiving the ink container 401 and the packaging material 408 are closely contacted with each other. By doing so, the vibration during transportation is propagated to the ink container 401 to stir the settled coloring material in the ink during transportation.

(Other Embodiments)

In the foregoing embodiments, the self-dispersion type carbon black is used as the coloring material in the ink, but the present intention is not limited to the use of this material. The coloring material may be color pigment for yellow, magenta, cyan, red, green, blue or the like. A representative color pigment for magenta is quinacridone pigment, and the pigment for yellow is azo pigment. The present invention is not limited to the self-dispersion type pigment ink, but resin material dispersion type pigment ink is usable because the pigment ink exhibits similar tendency to the self-dispersion type pigment ink.

Another aspect of the present invasion will be described. In the case of the pigment ink, the pigment component settles due to the gravity when the pigment ink is left in the same orientation for a long term. When the high density ink resulting from the settling is supplied to the recording head, the nozzles of the recording head may be clogged. In the present invention, the problem is solved from the approach of establishing a state in which the high density ink does not exist adjacent to the ink supply port portion leading to the recording head even if the ink container is left in the same orientation for a long term. From this standpoint, the present invention provides the solution in which the ink supply port does not take the bottom position by providing a specific packaging. Then, the low density ink is present around the ink supply port. It is desirable that such ink that print density (OD value) on the print is sufficient is selected to maintain the print quality. In other to avoid the presence of the high density ink around the ink supply port, it is possible that ink supply port takes the top position. However, in such a case, there is a liability that ink leaks out through the air vent. Therefore, it is desirable, when the packaging is such that ink supply port takes a bottom position, that measurement is taken to avoid the ink leakage through the air vent.

As shown in FIG. 3, in the case of the color ink container having the divided inside spaces, an example of the packaging in which the present invention is accomplished for all of the color ink accommodating chambers is such that ink supply ports take the top positions, or all of the ink supply ports are disposed above the ink accommodating portion (inclined orientation, for example, referring to FIG. 3(*a*), approx. 45° inclination with the left-hand end at the top and right-hand end at the bottom may be used.

As described in the foregoing, according to the package of the present invention, the ink container is contained in the package with the orientation which is different from that in use. Therefore, in use, the coloring material in the ink therein is dispersed or diffuse to make the coloring material density distribution uniform, so that supply of the ink having a high coloring material density can be avoided. In addition, the orientation of ink container in the package may be such that ink supply port takes an upper position than the relatively high coloring material density region in the ink container resulted from the settling of the coloring material. By this, the production of high coloring material density region can be avoided adjacent the ink supply port. It is preferable that ink supply port is directed downward, or takes a bottom position, the relatively high coloring material density region is positioned above the ink supply port, and therefore, the coloring material in the region disperses toward the ink supply port so that coloring material is further dispersion to provide further uniform ink to be supplied to the outside.

According to another aspect of the present invention there is provided a package containing comprising: a packaging member; and An ink container which contains ink comprising pigment coloring material and solvent dispersing the coloring material and which has an ink supply port for permitting supply of the ink to an outside, wherein the ink container is mountable to an ink jet recording apparatus with the ink supply port at a lower position, said ink container accommodating an ink absorbing material for absorbing the ink and being provided with an air vent which is open for fluid communication between a space inside said ink container and ambience, wherein said ink container has, at a side adjacent a side having said ink supply port, a first portion and a second portion which is projected outwardly of the ink container beyond the first portion, said first portion continuing with the side having the ink supply port, wherein said adjacent side takes a lower position. By this, the coloring material can be dispersed further effectively to make the coloring material density distribution more uniform to prevent supply of the high coloring material density ink to the recording head.

While the invention has been described with reference to the structures disclosed herein, it is not confined to the details set forth and this application is intended to cover such modifications or changes as may come within the purpose of the improvements or the scope of the following claims.

What is claimed is:

1. A package comprising:

a packaging member; and an ink container which contains ink comprising pigment coloring material and solvent dispersing the coloring material and which has an ink supply port for permitting supply of the ink to an outside, wherein the ink container is mountable to an ink jet recording apparatus with the ink supply port at a lower position, said ink container accommodating an ink absorbing material for absorbing the ink and being provided with an air vent which is open for fluid communication between a space inside said ink container and ambience, wherein said ink container has, at a side adjacent a side having said ink supply port, a first portion and a second portion which is projected outwardly of the ink container beyond the first portion, said first portion continuing with the side having the ink supply port, wherein said adjacent side takes a lower position; and wherein said ink supply port and said air vent are opposed to each other in said package, and said ink supply port takes in said package a position at a level higher than the air vent, and when said adjacent side takes a lower position, it is at a position lower than said ink supply port.

2. A package according to claim 1, wherein said ink supply port takes in said package a position at a higher level than a relatively high coloring material density region in the ink resulting from settling of the coloring material in said package.

3. A package according to claim 1, wherein said pigment is carbon black.

4. A package according to claim 3, wherein said carbon black is self-dispersion type carbon black.

5. A package according to claim 1, wherein said pigment color is pigment.

* * * * *

UNITED STATES PATENT AND TRADEMARK OFFICE

CERTIFICATE OF CORRECTION

PATENT NO. : 6,719,416 B2
DATED : April 13, 2004
INVENTOR(S) : A. Hiromasa, M. Takenouchi, Y. Takizawa and Y. Kotaki It is certified that error appears in the above-identified patent and that said Letters Patent is hereby corrected as shown below:

Column 1,
Line 18, "package" should read -- packages --.
Line 31, "settles" should read -- settle --.
Line 51, "an" should read -- and a --.
Line 52, "are" should read -- is --.

Column 2,
Lines 2 and 52, "interraced" should read -- interlaced --.
Line 43, "particularly property" should read -- property --.
Line 54, "and" should be deleted.

Column 3,
Line 4, delete "said package,".
Line 13, "neighborhood" should read -- neighboring --.
Line 40, "containing" should read -- containing an ink container --.

Column 5,
Line 7, "color)." should read -- colors). --.
Line 31, "illustrated" should read -- illustrates --.

Column 6,
Line 6, "ink" (first occurrence) should be deleted.
Line 21, "corresponds the" should read -- correspond to the --.
Line 23, "constitutes" should read -- constitute --.
Line 34, "portion" should read -- portions --.
Line 41, "as" should read -- in a --.

Column 7,
Line 5, "at" should be deleted.
Line 8, "and the" (second occurrence) should be deleted.
Line 55, "th" should read -- the --.
Line 61, "and the" (second occurrence) should be deleted.

Column 9,
Line 4, "thus disperses" should read "thus dispersing".
Line 41, "functions." should read -- function. --.
Line 56, "intention" should read -- invention --.
Line 65, "invasion" should read -- invention --.

UNITED STATES PATENT AND TRADEMARK OFFICE

CERTIFICATE OF CORRECTION

PATENT NO. : 6,719,416 B2
DATED : April 13, 2004
INVENTOR(S) : A. Hiromasa, M. Takenouchi, Y. Takizawa and Y. Kotaki It is certified that error appears in the above-identified patent and that said Letters Patent is hereby corrected as shown below:

Column 10,
Line 14, "other" should read -- order --.
Line 26, "portion" should read -- portions --.
Line 29, "bottom" should read -- bottom) --.
Line 47, "dispersion" should read -- dispersed --.
Line 50, "containing" should read -- containing an ink container --.

Column 12,
Line 21, "color is" should read -- is color --.

Signed and Sealed this

Twenty-third Day of November, 2004

JON W. DUDAS
*Director of the United States Patent and Trademark Office*